US007792437B2

(12) United States Patent
You

(10) Patent No.: US 7,792,437 B2
(45) Date of Patent: Sep. 7, 2010

(54) METHOD AND APPARATUS FOR DETECTING COVER OPENING OF IMAGE FORMING APPARATUS AND METHOD AND APPARATUS FOR CONTROLLING SUPPLY OF POWER

(75) Inventor: Yong-Ho You, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 974 days.

(21) Appl. No.: 11/589,129

(22) Filed: Oct. 30, 2006

(65) Prior Publication Data

US 2007/0104495 A1 May 10, 2007

(30) Foreign Application Priority Data

Nov. 4, 2005 (KR) ..... 10-2005-0105471

(51) Int. Cl.
*G03G 15/00* (2006.01)

(52) U.S. Cl. ..... 399/9; 399/114

(58) Field of Classification Search ..... 399/9, 399/114

See application file for complete search history.

(56) References Cited

U.S. PATENT DOCUMENTS 5,657,132 A * 8/1997 Samii ..... 358/296
6,647,223 B2 * 11/2003 Ishii ..... 399/90
2005/0281579 A1 * 12/2005 Umeda et al. ..... 399/107
2007/0077085 A1 * 4/2007 Kitamura et al. ..... 399/110

FOREIGN PATENT DOCUMENTS

| | | |
|---|---|---|
| CN | 1347019 | 5/2002 |
| JP | 07-244452 | 9/1995 |
| KR | 1993-24123 | 11/1993 |
| KR | 94-2996 | 2/1994 |
| KR | 2005-58654 | 6/2005 |

* cited by examiner

*Primary Examiner*—David M Gray
*Assistant Examiner*—G. M. Hyder
(74) *Attorney, Agent, or Firm*—Roylance, Abrams, Berdo & Goodman, L.L.P.

(57) ABSTRACT

A method and apparatus for detecting a cover opening of an image forming apparatus and a method and apparatus for controlling the supply of power to the image forming apparatus by detecting cover opening are provided. A detection is made as to whether first and second covers for the image forming apparatus are both closed. A verification is made as to whether memory information of a predetermined memory placed in the first cover is detected, if at least any one of the first and second covers is open. A determination is made that the second cover is open, if the memory information is detected. Accordingly, a user can know which cover is open among covers provided in the image forming apparatus by using one switching element. In addition, since a circuit used for detecting cover opening can be implemented with low cost, maintenance of the circuit can be promptly carried out.

31 Claims, 6 Drawing Sheets

METHOD AND APPARATUS FOR DETECTING COVER OPENING OF IMAGE FORMING APPARATUS AND METHOD AND APPARATUS FOR CONTROLLING SUPPLY OF POWER

CROSS-REFERENCE TO RELATED PATENT APPLICATION

This application claims the benefit under 35 U.S.C. §119 (a) of Korean Patent Application No. 10-2005-0105471, filed on Nov. 4, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a method and apparatus for detecting an opening of a plurality of covers of an image forming apparatus by using one switching unit, and a method and apparatus for controlling the supply of power to the image forming apparatus by detecting a cover opening thereof, which can prevent power from being accidentally supplied to the image forming apparatus.

2. Description of the Related Art

An image forming apparatus may have covers to replace image developing and fixing units. Namely, a side cover is provided at a lateral portion of the image forming apparatus to replace a developing unit, and a top cover is provided at the upper portion of the image forming apparatus to replace a fixing unit.

For user protection, the image forming apparatus is designed to turn off a power source of 24V for preheating the image forming apparatus or a power source of 5V for driving a laser scanning unit (LSU) when any one of the two covers is open.

However, the conventional image forming apparatus includes two switching elements to sense an opening of the side and top covers. The manufacturing cost of the image forming apparatus increases, since a plurality of switching elements must be used.

When any one of the side and top covers is open or both covers are open, the conventional image forming apparatus generally displays only a message indicating that a cover is open. Therefore, a user does not know which cover is open or whether both covers are open.

Accordingly, there is a need for an improved system and method for detecting a cover opening of an image forming apparatus and a method and apparatus for controlling the supply of power to the image forming apparatus by detecting the cover opening.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide a method and apparatus for detecting cover opening of an image forming apparatus by using one switching element to facilitate a user's knowledge of which cover is open among the covers provided in the image forming apparatus.

An exemplary embodiment of the present invention also provides a method and apparatus for controlling the supply of power to an image forming apparatus by detecting cover opening thereof, which can prevent power from being supplied accidentally.

According to an aspect of an exemplary embodiment of the present invention, there is provided a method of detecting cover opening of an image forming apparatus, comprising detecting whether first and second covers of the image forming apparatus are both closed verifying whether memory information of a predetermined memory placed in the first cover is detected, if at least any one of the first and second covers is open, and determining that the second cover is open, if the memory information is detected.

According to another aspect of an exemplary embodiment of the present invention, a method of controlling the supply of power to an image forming apparatus by detecting cover opening is provided. A first power that is detected when first and second covers for the image forming apparatus are both closed is supplied to the image forming apparatus. A verification is made to determine whether the first power is detected. The first power is cut when the first power is not detected.

According to another aspect of an exemplary embodiment of the present invention an apparatus for detecting cover opening of an image forming apparatus is provided. A switching unit is turned on when first and second covers of the image forming apparatus are both closed and is turned off when at least any one of the first and second covers is open. A cover opening detection unit detects whether the first cover or the second cover is open according to a verification result of memory information of a predetermined memory placed in the first cover and a switching signal of the switching unit.

According to another aspect of an exemplary embodiment of the present invention, an apparatus for controlling the supply of power to an image forming apparatus by detecting a cover opening thereof is provided. A switch mode power supply (SMPS) supplies a first power for preheating the image forming apparatus and a second power for driving a laser scanning unit. A switching unit is turned on when first and second covers of the image forming apparatus are both closed and is turned off when at least any one of the first and second covers is open. A power supply detection unit detects whether the first power is supplied and a first power source supply control unit cuts the first power, if the power supply detection unit does not detect the first power.

BRIEF DESCRIPTION OF THE DRAWINGS

The above and other exemplary objects, features and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Hereinafter, a method of detecting cover opening of an image forming apparatus according to an exemplary embodiment of the present invention will be described in detail with reference to the accompanying drawings.

Figure 1:
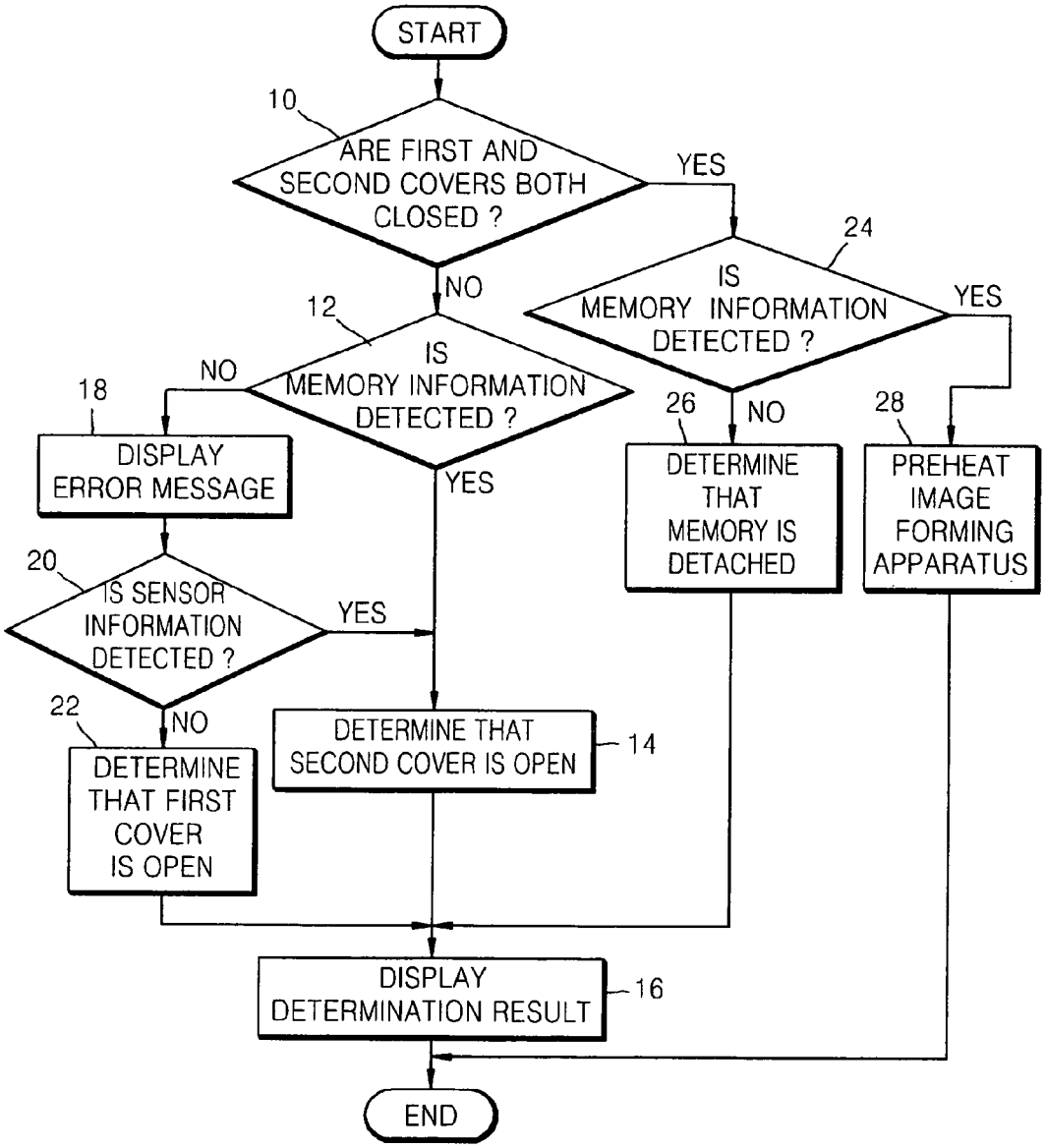
FIG. 1 is a flowchart of a method of detecting cover opening of an image forming apparatus according to an exemplary embodiment of the present invention.

FIG. 1 is a flowchart of a method of detecting cover opening of an image forming apparatus according to an exemplary embodiment of the present invention.

First, a detection is made as to whether first and second covers of the image forming apparatus are both closed (step 10). The first cover may be a side cover for replacing a developing unit of the image forming apparatus, and the second cover may be a top cover for replacing a fixing unit of the image forming apparatus.

Whether the first and second covers are both closed can be detected by detecting whether power is supplied for preheating the image forming apparatus. For example, if it is detected that power is supplied for preheating the image forming apparatus, it is determined that the first and second covers are closed, and if it is not detected that power source is supplied for preheating the image forming apparatus, it is determined that at least any one of the first and second covers is open.

If at least any one of the first and second covers is open, a verification is made as to whether memory information of a memory placed in the first cover is detected (step 12).

The predetermined memory is a transfer belt memory, and the memory information is transfer belt information. The transfer belt information includes, for example, a lifespan of a transfer belt and the amount of waste toner collected after developing is performed.

If the memory information is detected, a determination is made that the second cover is open (step 14). According to the detection result of step 10 that at least any one of the first and second covers is open, it can be concluded that the second cover is open.

After step 14, a determination result indicating that the second cover is open is displayed (step 16).

Meanwhile, if the memory information is not detected in step 12, an error message indicating that the memory information is not detected is displayed (step 18).

After step 18, a verification is made as to whether sensor information of a sensor placed in the first cover is detected (step 20).

In an exemplary implementation, the sensor is a color registration sensor, and the sensor information is color registration information. The color registration information is, for example, about an arrangement status of colors R, G, and B.

If the sensor information is not detected, it is determined that the first cover is open (step 22).

If the information of the sensor provided in the first sensor is not detected, it is determined that the first cover is open.

After step 22, step 16 is performed to display a determination result indicating that the first cover is open.

Meanwhile, if the sensor information is detected in step 22, step 14 is performed to determine that the second cover is open. If the sensor information is detected, it is determined that the first cover is closed. Thus, according to the detection result of step 10 that at least any one of the first and second covers is open, it can be concluded that the second cover is open.

Meanwhile, if is determined that both the first and second covers are closed in step 10, a verification is made as to whether the memory information of the memory placed in the first cover is detected (step 24).

If the memory information is not detected, it is determined that the memory is detached from the first cover (step 26). If the memory information is not detected even when the fist cover is closed, it is determined that the memory is detached from the first cover.

After step 26, step 16 is performed to display a determination result indicating that the memory is detached from the first cover.

Meanwhile, if the memory information is detected in step 24, preheating is performed for driving the image forming apparatus (step 28). If the first and second covers are both closed, and the memory is placed in the first cover, all elements for driving the image forming apparatus are in a normal condition. Thus, preheating is performed for driving the image forming apparatus.

Meanwhile, the exemplary embodiments of the present invention can be written as computer code/instructions/programs and can be implemented in general-use digital computers that execute the code/instructions/programs using a computer readable recording medium. Examples of the computer readable recording medium include magnetic storage media (for example, ROM, floppy disks and hard disks, among others), optical recording media (for example, CD-ROMs, or DVDs), and storage media such as carrier waves (for example, transmission through the Internet). The computer readable recording medium can also be distributed over network coupled computer systems so that the computer readable code is stored and executed in a distributed fashion.

Hereinafter, a method of controlling supply of power by detecting cover opening of an image forming apparatus of an exemplary embodiment of the present invention will be described in detail with reference to the accompanying drawings.

Figure 2:
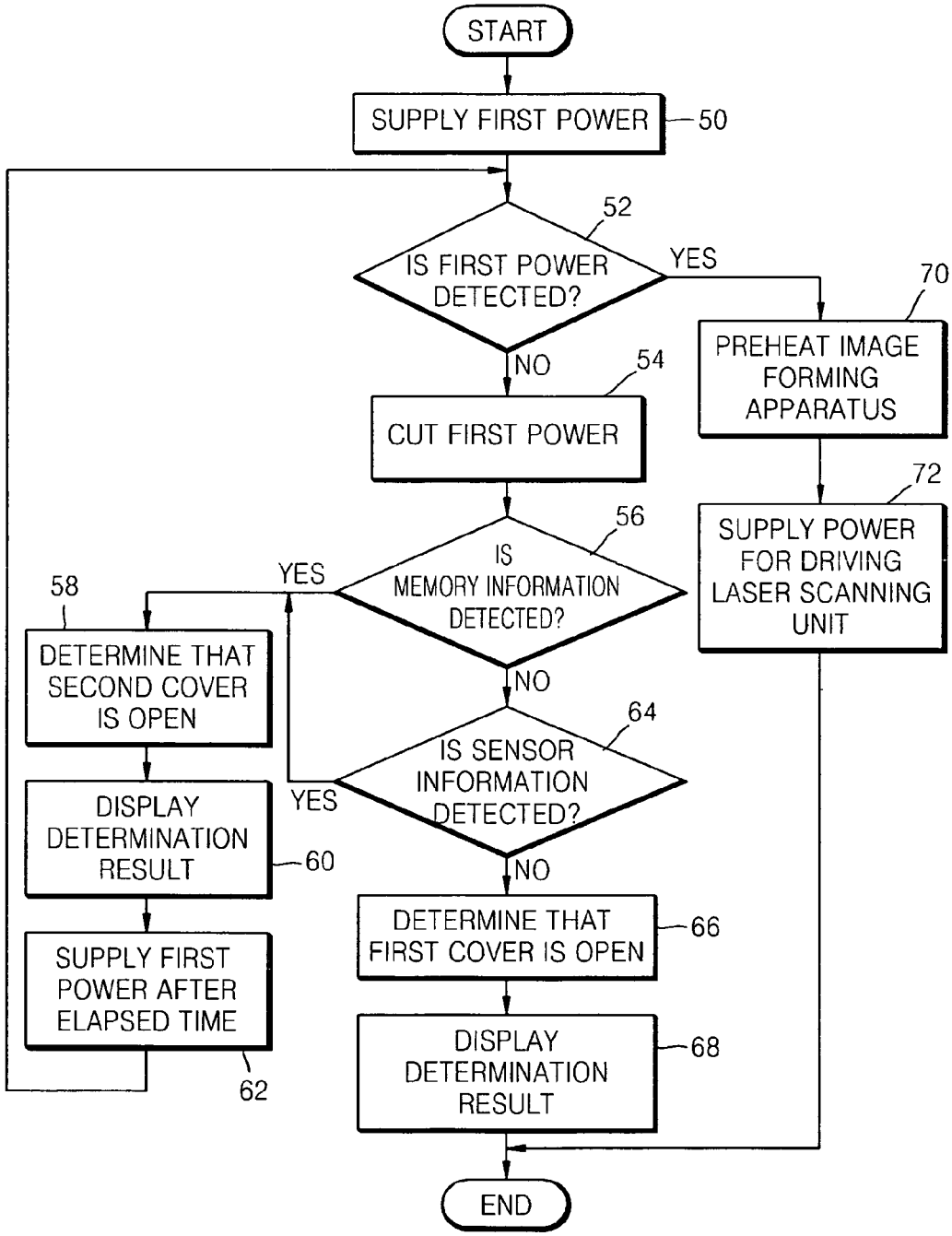
FIG. 2 is a flowchart of a method of controlling the supply of power to an image forming apparatus by detecting cover opening thereof, according to an exemplary embodiment of the present invention.

FIG. 2 is a flowchart of a method of controlling the supply of power to an image forming apparatus by detecting a cover opening thereof, according to an exemplary embodiment of the present invention.

A first power, which is detected when the first and second covers for the image forming apparatus are both closed, is supplied to the image forming apparatus (step 50). The first power is for preheating the image forming apparatus, and a second power is for emitting a laser of a laser scanning unit (LSU).

After step 50, a verification of whether the first power is detected (step 52) is made. If the first power is not detected, the first power is cut (step 54). If the first power is not detected, then the covers of the image forming apparatus are open. In this case, the first power has to be cut for user protection, but the first power may be continuously supplied due to a circuit error. To prevent this, the first power supplied by a power supply unit has to be cut.

After step 54, a verification is made as to whether the memory information of the predetermined memory placed in the first cover is detected (step 56). The predetermined memory is a transfer belt memory, and the memory information is transfer belt information.

If the memory information is detected, it is determined that the second cover is open (step 58). If the information of the memory provided in the first cover is detected, the first cover is closed. Since the detection result of step 52 that the first power source is not detected means that at least any one of the first and second covers is open, it can be concluded that the second cover is open.

After step 58, a determination result indicating that the second cover is open is displayed (step 60).

After step 60, the first power is supplied after an elapsed time, and step 52 is performed (step 62).

Meanwhile, if the memory information is not detected in step 56, a verification is made of whether the sensor information of the predetermined sensor placed in the first cover is detected (step 64). The predetermined sensor is a color registration sensor, and the sensor information is color registration information.

If the sensor information is not detected, it is determined that the first cover is open (step 66). If the information of the sensor provided in the first sensor is not detected, then the sensor information cannot be detected because the first cover is open.

After step 66, a determination result indicating that the first cover is open is displayed (step 68).

If the sensor information is detected in step 64, step 58 is performed. If the sensor information is detected, then the first cover is closed. Since the detection result of step 52 that the first power is not detected means that at least any one of the first and second covers is open, it can be concluded that the second cover is open.

If the first power is detected in step 52, preheating is performed for driving the image forming apparatus (step 70). If the first power is detected, then the first and second covers are both closed. Further, since the predetermined memory is placed in the first cover, all elements for driving the image forming apparatus are in a normal condition. Thus, preheating is performed for driving the image forming apparatus.

After step 70, according to a detection result of the first power in step 52, the supply of the second power source for driving the LSU is controlled (step 72). If the first power is detected in step 52, the second power for driving the LSU is supplied thereto. Although step 72 may follow step 70, step 72 may also follow step 52. If the first power is not detected in step 52, the second power is not supplied to the LSU.

The exemplary embodiments of the present invention can be written as computer code/instructions/programs and can be implemented in general-use digital computers that execute the code/instructions/programs using a computer readable recording medium. Examples of the computer readable recording medium include magnetic storage media (for example, ROM, floppy disks and hard disks, among others), optical recording media (for example, CD-ROMs, or DVDs), and storage media such as carrier waves (for example, transmission through the Internet). Also, the computer readable recording medium can also be distributed over network coupled computer systems so that the computer readable code is stored and executed in a distributed fashion.

An apparatus for sensing a cover opening of an image forming apparatus of an exemplary embodiment of the present invention will be described in detail with reference to the accompanying drawings.

Figure 3A:
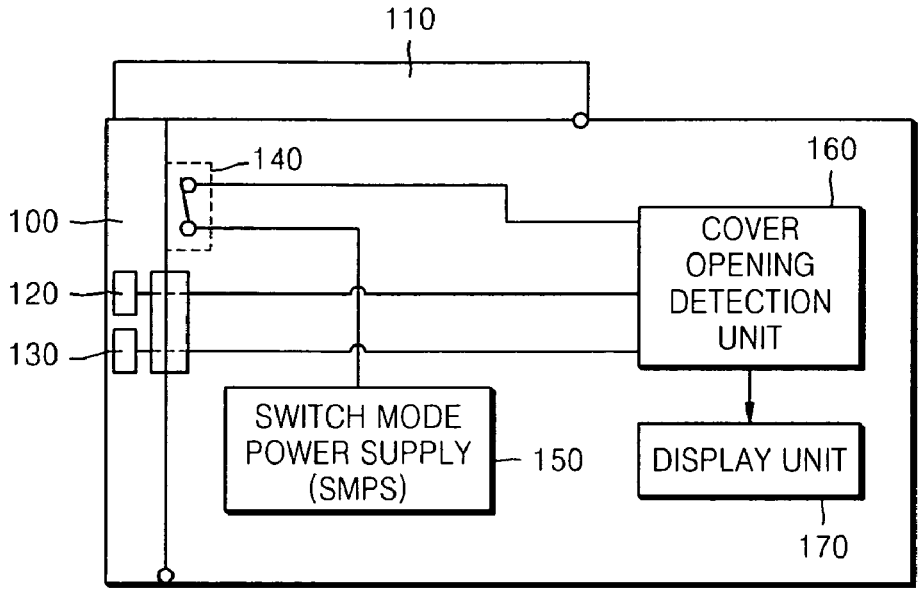
FIG. 3 is a block diagram of an apparatus for sensing cover opening of an image forming apparatus according to an exemplary embodiment of the present invention.
Figure 3B:
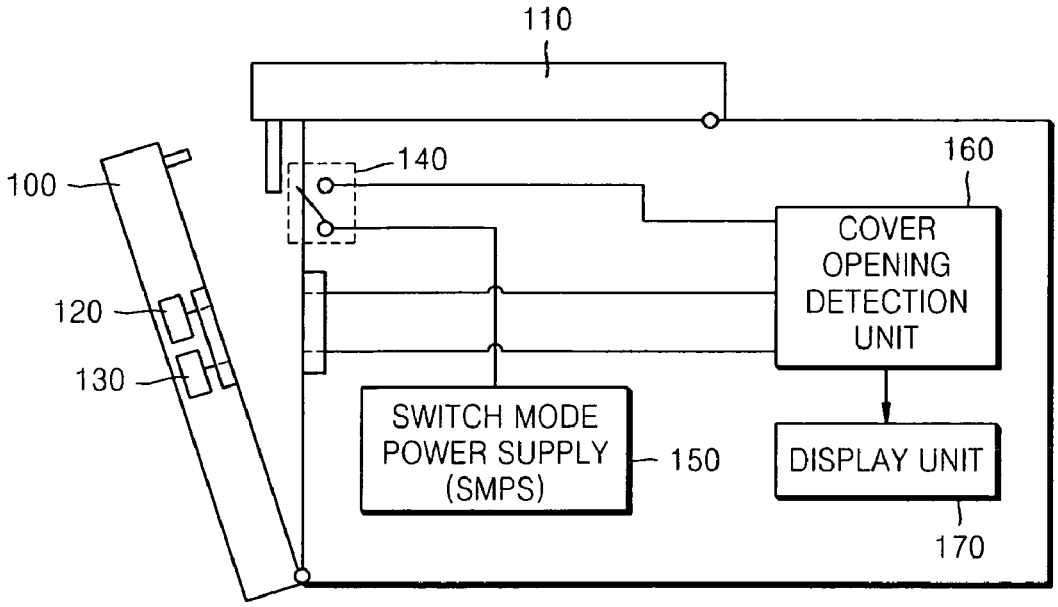

FIG. 3 is a block diagram of an apparatus for sensing a cover opening of an image forming apparatus according to an exemplary embodiment of the present invention, which includes a first cover 100, a second cover 110, a memory 120, a sensor 130, a switching unit 140, a switch mode power supply (SMPS) 150, a cover opening detection unit 160, and a display unit 170.

The first cover 100 may be a side cover for replacing a developing unit of the image forming apparatus.

The second cover 110 may be a top cover for replacing a fixing unit of the image forming apparatus.

Memory 120 is placed in the first cover 100. Memory information stored in the memory 120 is output to the cover opening detection unit 160. For example, memory 120 is a transfer belt memory, and the memory information is transfer belt information.

Sensor 130 is placed in the first cover 100. Sensor information stored in sensor 130 is output to the cover opening detection unit 160. For example, sensor 130 is a color registration sensor, and the sensor information is color registration information.

The switching unit 140 is switched on when the first cover 100 and the second cover 110 for the image forming apparatus are both closed, and is switched off when at least any one of the first cover 100 and the second cover 110 is open. The switching unit 140 outputs a switching result to the cover opening detection unit 160.

The SMPS 150 supplies power to the image forming apparatus.

The cover opening detection unit 160 detects whether the first cover 100 or the second cover 110 is open according to a verification result of the memory information of memory 120 placed in the first cover 100 and a switching signal of the switching unit 140, and outputs the detection result to the display unit 170.

Figure 4:
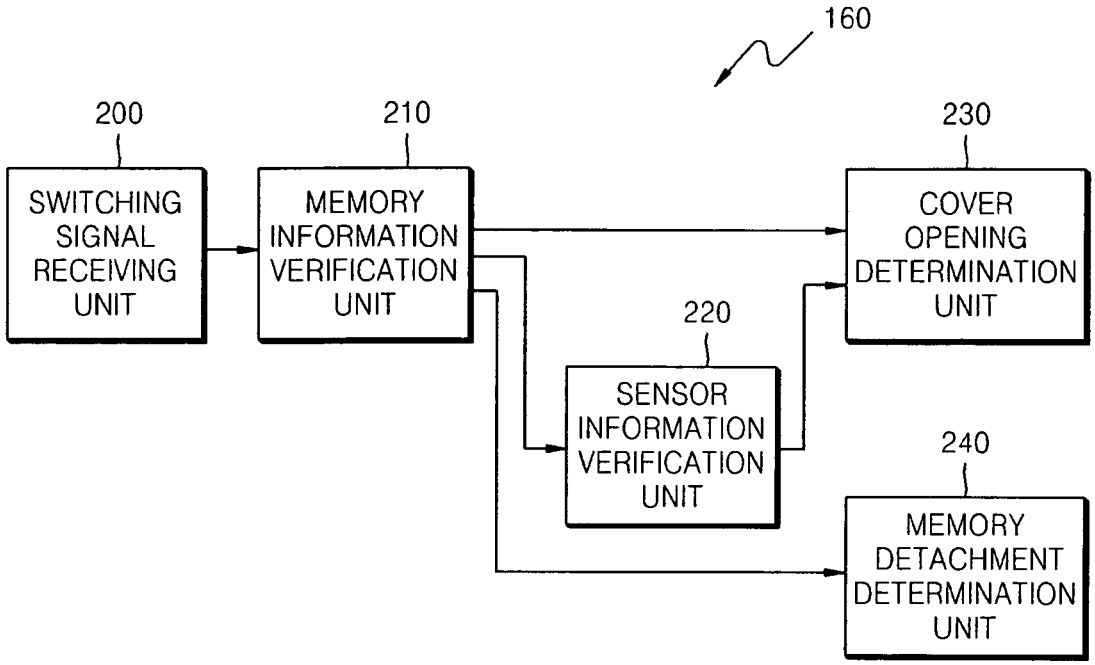
FIG. 4 is a block diagram of a cover opening detection unit of FIG. 3 according to an embodiment of the present invention.

FIG. 4 is a block diagram of the cover opening detection unit 160 of FIG. 3 according to an exemplary embodiment of the present invention, which includes a switching signal receiving unit 200, a memory information verification unit 210, a sensor information verification unit 220, a cover opening determination unit 230, and a memory detachment determination unit 240.

The switching signal receiving unit 200 receives an on-switching signal or an off-switching signal from the switching unit 140, and outputs the received result to the memory information verification unit 210.

When a signal received by the switching signal receiving unit 200 corresponds to the off-switching signal, the memory information verification unit 210 verifies whether the memory information is detected, and outputs the detection result to the sensor information verification unit 220 or the cover opening determination unit 230.

The memory information verification unit 210 outputs a verification result that the memory information of memory 120 is detected to the cover opening determination unit 230.

In addition, the memory information verification unit 210 outputs a verification result that the memory information of memory 120 is not detected to the sensor information verification unit 220.

In response to the verification result that the memory information of memory 120 is not detected, the sensor information verification unit 220 verifies whether the sensor information of sensor 130 placed in the first cover 100 is detected, and outputs the verification result to the cover opening determination unit 230.

In response to the verification result that the memory information of memory 120 is detected, the cover opening determination unit 230 determines that the second cover 110 is open. If the information of the memory provided in the first cover 100 is detected, then the first cover 100 is closed. Thus, judging from the off-switching signal that at least any one of the first cover 100 and the second cover 110 is open, it can be concluded that the second cover 110 is open.

In response to the verification result that the sensor information of sensor 130 is detected, the cover opening determination unit 230 determines that the second cover 110 is open. If the information of the sensor provided in the first cover 100 is detected, it means that the first cover 100 is closed. Thus, judging from the off-switching signal that at least any one of the first cover 100 and the second cover 110 is open, it can be concluded that the second cover 110 is open.

In response to the verification result that the sensor information of sensor 130 is not detected, the cover opening determination unit 230 determines that the first cover 100 is open. If the information of the sensor provided in the first cover 100 is not detected, then the sensor information cannot be detected because the first cover 100 is open.

When a signal received by the switching signal receiving unit 200 corresponds to the on-switching signal, and the memory information verification unit 210 outputs the verification result that the memory information is not detected, the memory detachment determination unit 240 determines that memory 120 is detached from the first cover 100. If the memory information is not detected even when the first cover 100 is closed, then memory 120 is detached from the first cover 100.

The display unit 170 displays determination results of the cover opening determination unit 230 and the memory detachment determination unit 240.

Hereinafter, an apparatus for controlling the supply of power to an image forming apparatus by detecting a cover opening thereof according to an exemplary embodiment of the present invention will be described in detail with reference to the accompanying drawings.

Figure 5A:
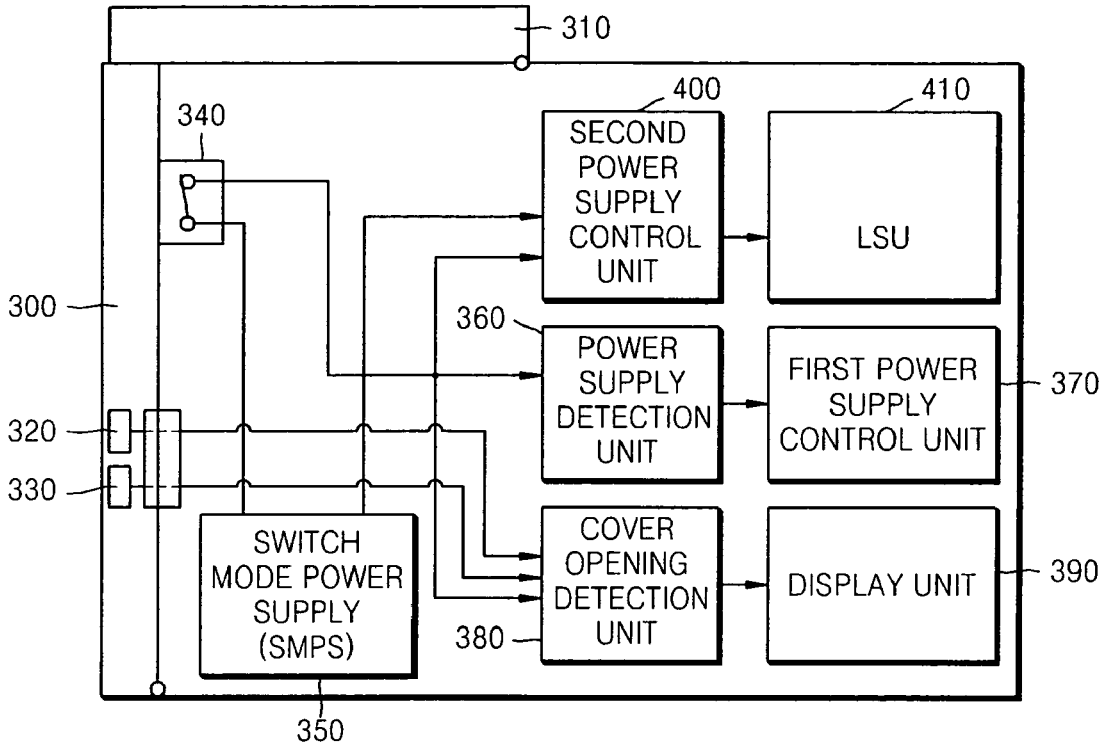
FIG. 5 is a block diagram of an apparatus for controlling the supply of power to an image forming apparatus by detecting a cover opening thereof according to an exemplary embodiment of the present invention.
Figure 5B:
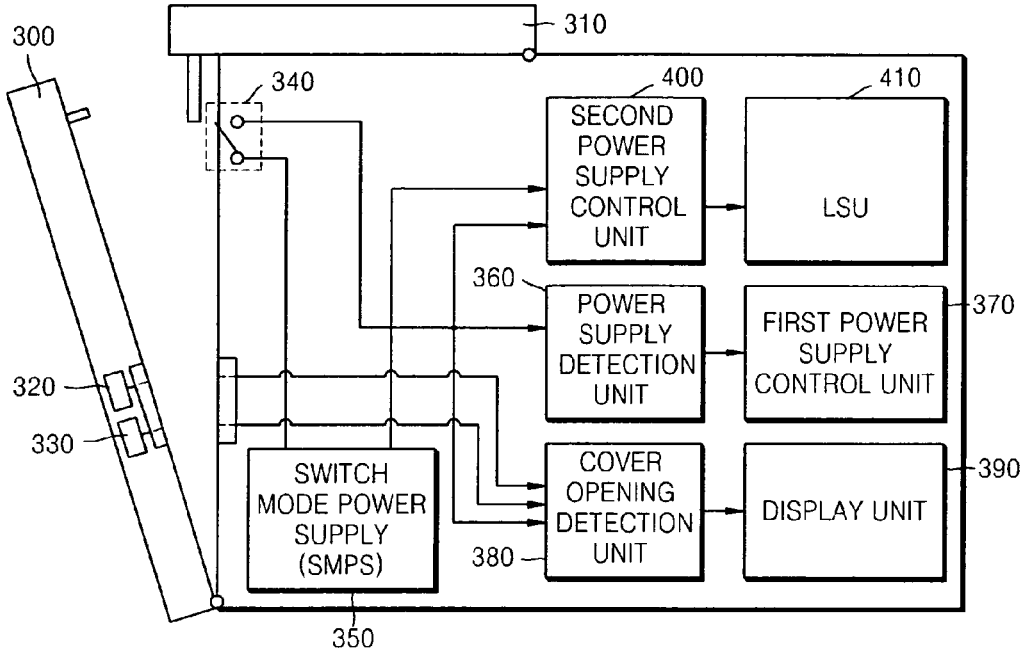

FIG. 5 is a block diagram of an apparatus for controlling the supply of power to an image forming apparatus by detecting cover opening thereof according to an exemplary embodiment of the present invention. The apparatus includes a first cover 300, a second cover 310, a memory 320, a sensor 330, a switching unit 340, a switch mode power supply (SMPS) 350, a power supply detection unit 360, a first power supply control unit 370, a cover opening detection unit 380, a display unit 390, a second power supply control unit 400, and a laser scanning unit (LSU) 410.

The first cover 300 may be a side cover for replacing a developing unit of the image forming apparatus.

The second cover 310 may be a top cover for replacing a fixing unit of the image forming apparatus.

Memory 320 is placed in the first cover 300. Memory information stored in memory 320 is output to the cover opening detection unit 380. For example, memory 320 is a transfer belt memory, and the memory information is transfer belt information.

Sensor 330 is placed in the first cover 300. Sensor information stored in sensor 330 is output to the cover opening detection unit 380. For example, sensor 330 is a color registration sensor, and the sensor information is color registration information.

The switching unit 340 is switched on when the first cover 300 and the second cover 310 for the image forming apparatus are both closed, and is switched off when at least any one of the first cover 300 and the second cover 310 is open. The switching unit 340 outputs a power supplied by the SMPS 350 through a switching operation to the power supply detection unit 360 and the cover opening detection unit 380.

The SMPS 350 supplies a first power for preheating the image forming apparatus and a second power for driving the LSU 410.

The power supply detection unit 360 detects whether the first power is supplied, and outputs the detection result to the first power supply control unit 370. When the first cover 300 and the second cover 310 are both closed, the power supply detection unit 360 detects that the first power is supplied.

When the power supply detection unit 360 receives a verification result that the first power is not detected, the first power supply control unit 370 cuts the first power. Thus, when the first cover 300 or the second cover 310 is open, the power can be prevented from being continuously supplied by the SMPS 350 due to circuit errors.

The cover opening detection unit 380 detects whether the first cover 300 or the second cover 310 is open according to a verification result of the memory information of memory 320 placed in the first cover 300 and a switching signal of the switching unit 340, and outputs the detection result to the display unit 390.

Figure 6:
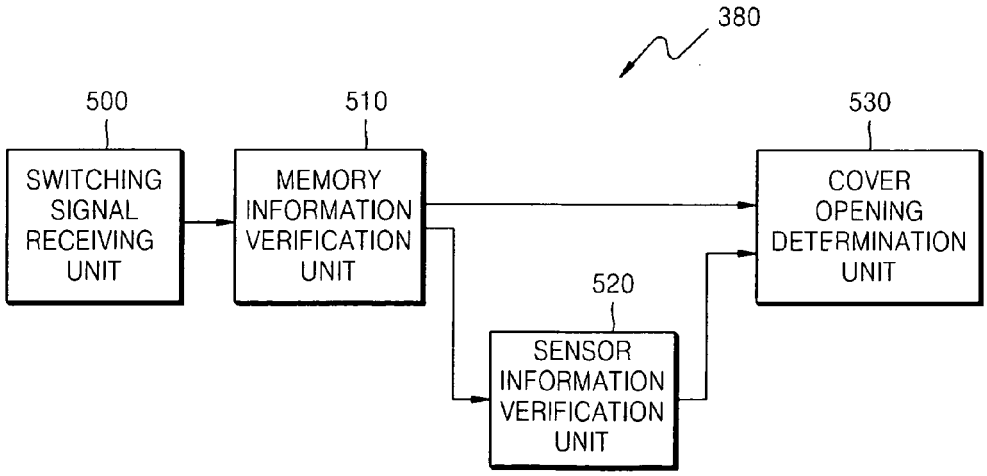
FIG. 6 is a block diagram of a cover opening detection unit of FIG. 5 according to an embodiment of the present invention.

FIG. 6 is a block diagram of the cover opening detection unit 380 of FIG. 5 according to an exemplary embodiment of the present invention, which includes a switching signal receiving unit 500, a memory information verification unit 510, a sensor information verification unit 520, and a cover opening determination unit 530.

The switching signal receiving unit 500 receives an on-switching signal or an off-switching signal from the switching unit 340, and outputs the received result to the memory information verification unit 510.

When a signal received by the switching signal receiving unit 500 corresponds to the off-switching signal, the memory information verification unit 510 verifies whether the memory information is detected, and outputs the detection result to the sensor information verification unit 520 or the cover opening determination unit 530.

The memory information verification unit 510 outputs a verification result that the memory information of memory 320 is detected to the cover opening determination unit 530.

The memory information verification unit 510 also outputs a verification result that the memory information of memory 320 is not detected to the sensor information verification unit 520.

In response to the verification result that the memory information of memory 320 is not detected, the sensor information verification unit 520 verifies whether the sensor information of sensor 330 placed in the first cover 300 is detected, and outputs the verification result to the cover opening determination unit 530.

In response to the verification result that the memory information of memory 320 is detected, the cover opening determination unit 530 determines that the second cover 310 is open. If the information of the memory provided in the first cover 300 is detected, then the first cover 300 is closed. Thus, judging from the off-switching signal that at least any one of the first cover 300 and the second cover 310 is open, a conclusion can be made that the second cover 310 is open.

In response to the verification result that the memory information of sensor 330 is detected, the cover opening determination unit 530 determines that the second cover 310 is open.

If the information of the sensor provided in the first cover 300 is detected, then the first cover 300 is closed. Thus, judging from the off-switching signal that at least any one of the first cover 300 and the second cover 310 is open, a conclusion can be made that the second cover 310 is open.

In response to the verification result that the sensor information of sensor 330 is not detected, the cover opening determination unit 530 determines that the first cover 300 is open. If the information of the sensor provided in the first cover 300 is not detected, then the sensor information cannot be detected because the first cover 300 is open.

The display unit 390 displays a determination result of the cover opening determination unit 530.

According to a detection result of the first power, the second power supply control unit 400 controls the supply of the second power to the LSU 410. Namely, if the first power is detected, the second power supply control unit 400 supplies the second power for driving the LSU 410 to the LSU 410. Meanwhile, if the first power is not detected, the second power supply control unit 400 cuts the second power supplied to the LSU 410.

Accordingly, in a method and apparatus for detecting cover opening of an image forming apparatus of an exemplary embodiment of the present invention, a user can know which cover is open among covers provided in the image forming apparatus by using one switching element.

Since a circuit used for detecting cover opening can be implemented with low cost, maintenance of the circuit can be promptly carried out.

In addition, when a cover is open, for user protection, a power can be prevented from being supplied due to circuit errors.

While the present invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. A method of detecting cover opening of an image forming apparatus, comprising:

detecting whether first and second covers for the image forming apparatus are both closed;

first verifying whether memory information of a memory placed in the first cover is detected, if at least any one of the first and second covers is open; and first determining that the second cover is open, if the memory information is detected.

2. The method of claim 1, wherein the memory comprises a transfer belt memory, and the memory information comprises transfer belt information.

3. The method of claim 1, further comprising displaying a result of the first determining.

4. The method of claim 1, further comprising:

second verifying whether sensor information of a sensor placed in the first cover is detected, if the memory information is not detected in the first verifying; and second determining that the first cover is open, if the sensor information is not detected.

5. The method of claim 4, wherein the sensor comprises a color registration sensor, and the sensor information comprises color registration information.

6. The method of claim 4, further comprising displaying a result determined in the second determining.

7. The method of claim 4, wherein the first determining is performed, if the sensor information is detected in the first verifying.

8. The method of claim 4, further comprising displaying an error message indicating that the memory information is not detected, if the memory information is not detected in the first verifying.

9. The method of claim 1, further comprising:

third verifying whether the memory information of the memory placed in the first cover is detected, if the first and second covers are both closed; and third determining that the memory is detached from the first cover, if the memory information is not detected.

10. The method of claim 9, further comprising displaying a result determined in the third determining.

11. The method of claim 4, further comprising preheating the image forming apparatus, if the memory information is detected in the third verifying.

12. A computer-readable medium comprising embodied thereon a computer program for executing the method of claim 1.

13. An apparatus for detecting cover opening of an image forming apparatus, comprising:

a switching unit which is switched on when first and second covers for the image forming apparatus are both closed, and is switched off when at least any one of the first and second covers is open; and a cover opening detection unit for detecting whether at least one of the first cover and the second cover is open, according to a verification result of memory information of a memory placed in the first cover and a switching signal of the switching unit.

14. The apparatus of claim 13, wherein the memory comprises a transfer belt memory, and the memory information comprises transfer belt information.

15. The apparatus of claim 13, wherein the cover opening detection unit comprises:

a switching signal receiving unit for receiving at least one of an on-switching signal and an off-signal switching from the switching unit;

a memory information verification unit for verifying whether the memory information is detected, when a switching signal received by the switching signal receiving unit corresponds to the off-switching signal; and a cover opening determination unit for determining that the second cover is open, when the memory information is detected.

16. The apparatus of claim 15, further comprising a display unit displaying a determination result of the cover opening determination unit.

17. The apparatus of claim 15, the cover opening detection unit further comprising a sensor information verification unit for verifying whether sensor information of a sensor placed in the first cover is detected, if the memory information is not detected, wherein the cover opening determination unit determines that the first cover is open, if the sensor information is not detected.

18. The apparatus of claim 17, wherein the sensor comprises a color registration sensor, and the sensor information comprises color registration information.

19. The apparatus of claim 18, wherein the cover opening detection unit determines that the second cover is open, if the sensor information is detected.

20. The apparatus of claim 15, wherein the cover opening detection unit further comprises a memory detachment determination unit determining that the memory is detached from the first cover, when a switching signal received by the switching signal receiving unit corresponds to the on-switching signal, and the memory information verification unit outputs a determination result indicating that the memory information is not detected.

21. The apparatus of claim 20, further comprising a display unit displaying a determination result of the memory detachment determination unit.

22. A method of detecting cover opening of an image forming apparatus, comprising:

detecting whether first and second covers for the image forming apparatus are both closed;

first verifying whether memory information of a memory placed in the first cover is detected, if at least any one of the first and second covers is open;

first determining that the second cover is open, if the memory information is detected;

second verifying whether sensor information of a sensor placed in the first cover is detected, if the memory information is not detected in the first verifying;

second determining that the first cover is open, if the sensor information is not detected;

third verifying whether the memory information of the memory placed in the first cover is detected, if the first and second covers are both closed; and third determining that the memory is detached from the first cover, if the memory information is not detected.

23. The method of claim 22, wherein the memory comprises a transfer belt memory, and the memory information comprises transfer belt information.

24. The method of claim 22, further comprising displaying a result of the first determining.

25. The method of claim 22, wherein the sensor comprises a color registration sensor, and the sensor information comprises color registration information.

26. The method of claim 22, further comprising displaying a result determined in the second determining.

27. The method of claim 22, wherein the first determining is performed, if the sensor information is detected in the first verifying.

28. The method of claim 22, further comprising displaying an error message indicating that the memory information is not detected, if the memory information is not detected in the first verifying.

29. The method of claim 22, further comprising displaying a result determined in the third determining.

30. The method of claim 22, further comprising preheating the image forming apparatus, if the memory information is detected in the third verifying.

31. A computer readable medium having stored thereon a computer program for executing a method of detecting a cover opening of an image forming apparatus, the method comprising:

a first set of instructions for detecting whether first and second covers for the image forming apparatus are both closed;

a second set of instructions for first verifying whether memory information of a memory placed in the first cover is detected, if at least any one of the first and second covers is open; and a third set of instructions for first determining that the second cover is open, if the memory information is detected.

* * * * *